US007367397B2

(12) United States Patent
Clemens et al.

(10) Patent No.: US 7,367,397 B2
(45) Date of Patent: May 6, 2008

(54) DOWNHOLE IMPACT GENERATOR AND METHOD FOR USE OF SAME

(75) Inventors: Jack G. Clemens, Plano, TX (US); Jerry C. Foster, Lewisville, TX (US); Robert L. Thurman, Frisco, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 108 days.

(21) Appl. No.: 11/326,229

(22) Filed: Jan. 5, 2006

(65) Prior Publication Data

US 2007/0151732 A1 Jul. 5, 2007

(51) Int. Cl.
*E21B 31/107* (2006.01)

(52) U.S. Cl. ..... 166/301; 166/178; 166/65.1

(58) Field of Classification Search ..... 166/65.1, 166/66.4, 178, 301; 175/299, 304
See application file for complete search history.

(56) References Cited

U.S. PATENT DOCUMENTS

| | | | | |
|---|---|---|---|---|
| 2,091,680 | A * | 8/1937 | Greenlee | 173/91 |
| 4,687,054 | A | 8/1987 | Russell et al. | |
| 5,069,282 | A | 12/1991 | Taylor | |
| 5,070,941 | A | 12/1991 | Kilgore | |
| 5,103,903 | A | 4/1992 | Marks, II | |
| 5,139,086 | A | 8/1992 | Griffith, Sr. | |
| 5,197,773 | A | 3/1993 | Vick, Jr. | |
| 5,228,507 | A | 7/1993 | Obrejanu et al. | |
| 5,267,613 | A | 12/1993 | Zwart et al. | |
| 5,330,018 | A | 7/1994 | Griffith | |
| 5,492,173 | A | 2/1996 | Kilgore et al. | |
| 5,775,433 | A | 7/1998 | Hammett et al. | |
| 5,988,287 | A | 11/1999 | Jordan, Jr. et al. | |
| 6,070,672 | A | 6/2000 | Gazada | |
| 6,199,628 | B1 | 3/2001 | Beck et al. | |
| 6,349,772 | B2 | 2/2002 | Mullen et al. | |
| 6,502,638 | B1 | 1/2003 | Stoesz | |
| 6,729,419 | B1 | 5/2004 | Lee | |

FOREIGN PATENT DOCUMENTS

| | | |
|---|---|---|
| EP | 0 511 789 A2 | 11/1992 |
| EP | 0 931 906 A2 | 7/1999 |

(Continued)

OTHER PUBLICATIONS

Downhole Wirefinder with Power Unit, ip.com Prior Art Database.

*Primary Examiner*—Kenneth Thompson
(74) *Attorney, Agent, or Firm*—Lawrence R. Youst

(57) ABSTRACT

A downhole impact generator (60) is adapted to be moved to a target location within a wellbore (68) for transmitting a jarring force to a well tool (72) positioned in the wellbore (68). The downhole impact generator (60) includes a downhole power unit (62) having a moveable shaft (66) and a jarring tool (64). The jarring tool (64) is operably engageable with the well tool (72) and is operably coupled with the moveable shaft (66) of the downhole power unit (62) such that when the jarring tool (64) is operably engaged with the well tool (72), linear movement of the moveable shaft (66) energizes the jarring tool (64) such that a jarring force can be transmitted by the jarring tool (64) to the well tool (72).

34 Claims, 9 Drawing Sheets

FOREIGN PATENT DOCUMENTS

| | | |
|---|---|---|
| EP | 0 952 302 A2 | 10/1999 |
| EP | 1 344 893 A2 | 9/2003 |
| EP | 0 999 343 B1 | 4/2004 |
| WO | WO 03/048511 A1 | 6/2003 |
| WO | WO 2004/013457 | 2/2004 |

* cited by examiner 32
10
20
12
18
26
30
22
44
24
16
46
48
42
50
40
28
36
38
14
34

DOWNHOLE IMPACT GENERATOR AND METHOD FOR USE OF SAME

TECHNICAL FIELD OF THE INVENTION

This invention relates, in general, to generating a jarring force within a wellbore and, in particular, to a downhole impact generator that is positioned relative to a downhole tool installed in the wellbore then operated to apply a jarring force to the downhole tool.

BACKGROUND OF THE INVENTION

Without limiting the scope of the present invention, its background will be described with reference to retrieving a well tool that was previously installed within a well, as an example.

After drilling a well that intersects a subterranean hydrocarbon bearing reservoir, a variety of well tools are often positioned in the wellbore during completion, production or remedial activities. For example, temporary packers are often set in the wellbore during the completion and production operating phases of the well. In addition, various operating tools including flow controllers such as plugs, chokes, valves and the like and safety devices such as safety valves are often retrievably positioned in the wellbore.

In the event that one of these well tools that has been previously installed within the wellbore requires removal, a pulling tool attached to a conveyance such as a wireline, a slickline or the like is typically run downhole to the location of the well tool to be removed. The pulling tool, which may include a fishing nose and latching assembly, is coupled to a fishing neck on the installed well tool. Thereafter, the well tool can be released from the wellbore and retrieved to the surface.

It has been found, however, that over time a well tool installed within the wellbore may become stuck in the wellbore and may require an impact or jarring force to be applied thereto in order to dislodge the well tool from its stuck position. In addition, it has been found that certain retrieval operations place significant demands on the integrity and strength of the conveyance, particularly in wells that are deep, deviated, inclined or horizontal due to the cumulative weight of the conveyance and frictional effects.

Accordingly, prior art retrieval tools can only apply a limited amount of force to directly dislodge a stuck well tool or to actuate a jarring tool such that an impact can be delivered to dislodge the stuck well tool. Therefore, a need has arisen for a downhole impact generator that can generate an impact to exert a jarring force on a stuck well tool such that the stuck well tools can be dislodged. A need has also arisen for such a downhole impact generator that will produce the necessary jarring force to dislodge well tools that have been installed and become stuck within deep, deviated, inclined or horizontal wellbores. Additionally, a need has also arisen for such a downhole impact generator that can be used to provide multiple impacts to dislodge stuck well tools. Further, a need has also arisen for such a downhole impact generator that will produce the necessary jarring force to dislodge well tools without requiring force to be generated via the conveyance.

SUMMARY OF THE INVENTION

The present invention disclosed herein comprises a downhole impact generator and a method for using the downhole impact generator that are capable of providing a sufficient impact to dislodge a well tool that is stuck within the wellbore. The downhole impact generator of the present invention will produce the necessary impact to dislodge a well tool that have been installed and becomes stuck within deep, deviated, inclined or horizontal wellbores. Additionally, the downhole impact generator of the present invention will produce the necessary impact to dislodge well tools without requiring force to be generated via the conveyance. Further, the downhole impact generator of the present invention can be used to provide a single or multiple impacts to dislodge well tools. Also, the downhole impact generator of the present invention may be used to actuate well tools from one operational state to another operational state even if the well tool has become stuck in its present operational state.

The downhole impact generator of the present invention is adapted to be moved to a target location within a wellbore for delivering an impact or jarring force to a well tool positioned within the wellbore. The well tool may be any type of well tool positioned downhole requiring intervention of some type including shifting, actuation, repositioning, retrieval or the like. The well tool may be in a desired or known location downhole or in an undesired or unknown location downhole in the case of certain fishing operations.

In one aspect, the present invention is directed to a downhole impact generator that includes a downhole power unit having a moveable shaft and a jarring tool. The jarring tool is operably engageable with the well tool and is operably coupled with the moveable shaft of the downhole power unit such that when the jarring tool is operably engaged with the well tool, linear movement of the moveable shaft in the longitudinal direction of the downhole power unit energizes the jarring tool such that a jarring force can be transmitted by the jarring tool to the well tool.

In one embodiment, the downhole power unit includes a self-contained power source for providing electrical power and a controller that controls the operation of the moveable shaft. In another embodiment, the downhole power unit is coupled to a surface controller via a conductor cable that provides power and controls the operation of the moveable shaft. In either embodiment, the downhole power unit may include an electric motor including a rotor and a jackscrew assembly including a rotational member connected to the rotor. The rotational member is operably associated with the moveable shaft to impart motion thereto. The moveable shaft of the downhole power unit may be linearly moveable such that the downhole impact generator generates a linear force on the jarring tool.

In one embodiment, the jarring tool of the downhole force generator of the present invention includes a shifting tool for actuating a well tool from one operational state to another operational state. In another embodiment, the jarring tool includes a pulling tool for dislodging and retrieving a well tool from the wellbore. In this embodiment, the pulling tool may include a latching assembly that engages the well tool and a fishing nose that engages a fishing neck of the well tool.

In one embodiment of the downhole impact generator, linear movement of the moveable shaft in a first direction cocks the jarring tool, linear movement of the moveable shaft in a second direction energizes the jarring tool and further linear movement of the moveable shaft in the second direction releases the jarring tool to transmit the jarring force.

In another aspect, the present invention is directed to a downhole impact generator that includes a downhole power unit having a moveable shaft, anchor and a jarring tool. The anchor is operable between a radially contracted configuration or running configuration and a radially expanded configuration or anchoring configuration. The anchor is operated between these positions in response to movement of the moveable shaft of the downhole power unit. In the radially expanded configuration, the anchor longitudinally secures the downhole impact generator within the wellbore. The jarring tool is operably engageable with the well tool and is operably coupled with the moveable shaft of the downhole power unit such that when the jarring tool is operably engaged with the well tool and the anchor is in the anchoring configuration, linear movement of the moveable shaft energizes the jarring tool such that a jarring force can be transmitted by the jarring tool to the well tool.

In one embodiment, the anchor of the downhole impact generator of the present invention includes barrel slips that mechanically engage the wellbore when the anchor is in the radially expanded configuration. In another embodiment, the anchor includes a packing assembly that sealingly engages the wellbore when the anchor is in the radially expanded configuration. In yet another embodiment, the anchor includes a spring assembly that stores energy when the anchor is in the radially expanded configuration.

In a further aspect, the present invention is directed to a method for transmitting a jarring force to a well tool positioned in a wellbore. The method includes running a downhole impact generator, including a downhole power unit having a moveable shaft and a jarring tool, to a target location in the wellbore, operably engaging the well tool with the downhole impact generator, energizing the jarring tool by linear movement of the moveable shaft and transmitting the jarring force to the well tool with the downhole impact generator. The method may also involve repeating the steps of energizing the jarring tool by linear movement of the moveable shaft and transmitting the jarring force to the well tool with the downhole impact generator as required.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1:
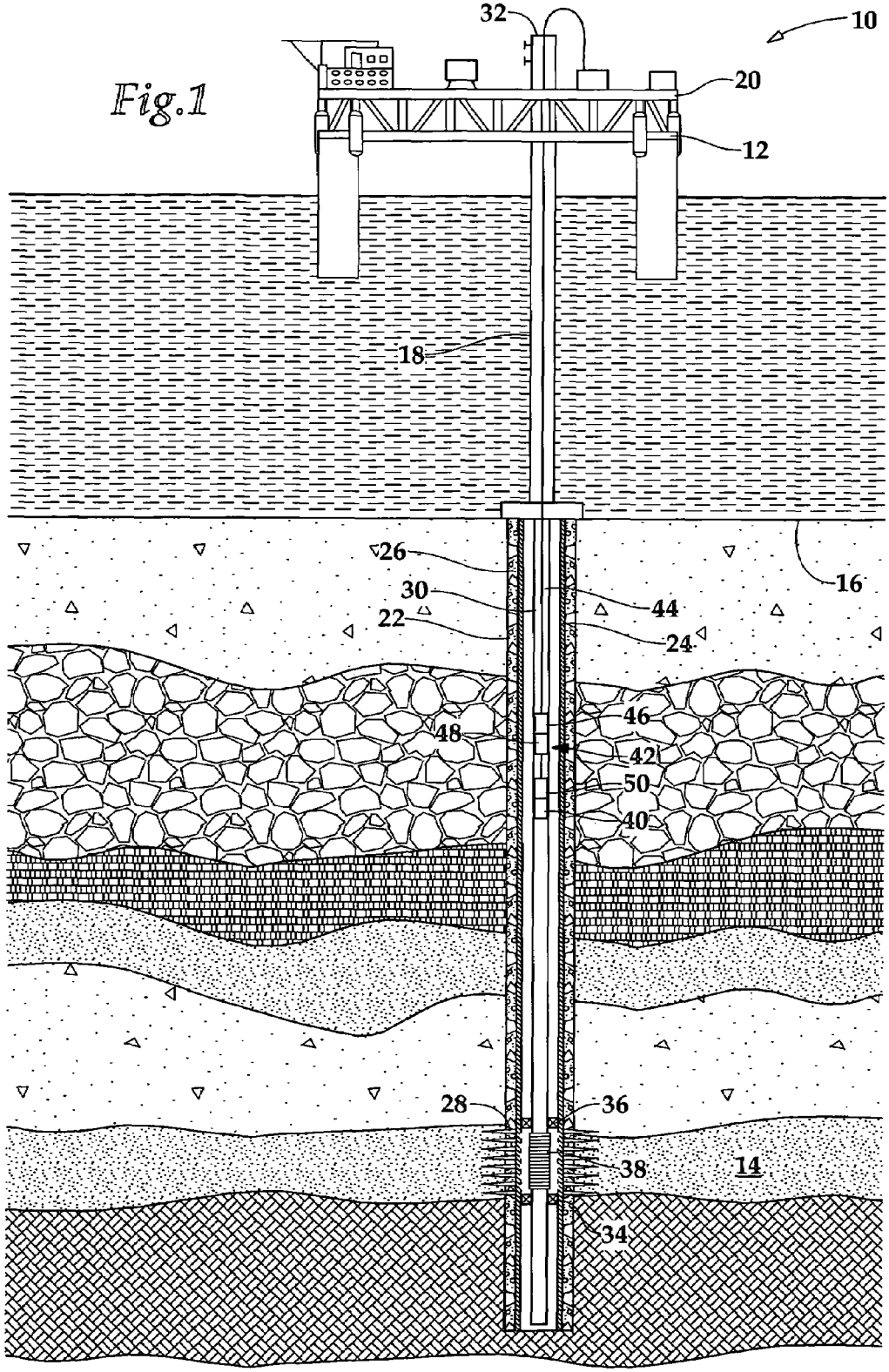
FIG. 1 is a schematic illustration of an offshore oil and gas platform operating a downhole impact generator according to the present invention.

Referring initially to FIG. 1, a downhole impact generator of the present invention is being operated from an offshore oil and gas platform that is schematically illustrated and generally designated 10. A semi-submersible platform 12 is centered over a submerged oil and gas formation 14 located below sea floor 16. A subsea conductor 18 extends from deck 20 of platform 12 to sea floor 16. A wellbore 22 extends from sea floor 16 and traverse formation 14. Wellbore 22 includes a casing 24 that is cemented therein by cement 26. Casing 24 has perforations 28 in the interval proximate formation 14.

A tubing string 30 extends from wellhead 32 to formation 14 to provide a conduit for production fluids to travel to the surface. A pair of packers 34, 36 provide a fluid seal between tubing string 30 and casing 24 and direct the flow of production fluids from formation 14 through sand control screen 38. Disposed within tubing string 30 is a well tool 40 such as a flow control device, safety device or the like. A downhole impact generator 42 is being run downhole on a conveyance 44, such as a wireline, a slickline, an electric line, a jointed tubing, a coiled tubing or the like. Alternatively, downhole impact generator 42 may be run downhole via an autonomous conveyance such as a downhole robot. In the illustrated embodiment, downhole impact generator 42 includes a downhole power unit 46, an anchor 48 and a jarring tool 50. Jarring tool 50 is operably engageable with well tool 40 in a variety of ways depending upon the action to be performed on well tool 40 such as via a pulling tool, a shifting tool, a blind box or other tool capable of directly or indirectly interacting with well tool 40.

As an example, jarring tool 50 may incorporate a shifting tool such as a Halliburton BO shifting tool designed to actuate well tool 40 from one operational state to another operational state. As those skilled in the art will understand, if well tool 40 becomes stuck in one of its operational states, the force required to shift well tool 40 to another of its operational states may be high and may exceed the force which can be applied thereto by conventional wireline shifting tools. Downhole impact generator 42 of the present invention, however, can be used to apply the required jarring force to shift well tool 40 from its stuck operational state to its desired operational state. In the illustrated embodiment, this is achieved by deploying downhole impact generator 42 to the target location, engaging well tool 40 with jarring tool 50, anchoring downhole impact generator 42 within tubing string 30 with anchor 48, energizing jarring tool 50 with downhole power unit 46 and generating an impact with jarring tool 50 that delivers a jarring force to well tool 40, which operates well tool 40 from its current operational state to its desired operational state. For example, the jarring force may be used to break shear pins, shift a sliding sleeve or the like.

Similarly, if jarring tool 50 incorporates a lind box or a pulling tool, downhole impact generator 42 is capable of providing sufficient jarring force to dislodge well tool 40 from wellbore 22 even if well tool 40 has become stuck within wellbore 22. Specifically, downhole impact generator 42 can generate the required impact to create the necessary jarring force to dislodge well tools from deep, deviated, inclined or horizontal wellbores which may then be retrieved to the surface if desired. Accordingly, even though FIG. 1 depicts a vertical well, it should be noted by one skilled in the art that the downhole impact generator of the present invention is equally well-suited for use in deviated wells, inclined wells or horizontal wells. As such, the use of directional terms such as above, below, upper, lower, upward, downward and the like are used in relation to the illustrative embodiments as they are depicted in the figures, the upward direction being toward the top of the corresponding figure and the downward direction being toward the bottom of the corresponding figure. Also, even though FIG. 1 depicts an offshore operation, it should be noted by one skilled in the art that the downhole impact generator of the present invention is equally well-suited for use in onshore operations.

Referring now to FIGS. 2A-2D, therein is schematically depicted a downhole impact generator of the present invention that is generally designated 60. Downhole impact generator 60 includes a downhole power unit 62 and a jarring tool 64, each of which will be discussed in greater detail below. Downhole power unit 62 has a moveable member described herein as moveable shaft 66 that is operably associated with and coupled to a portion of jarring tool 64. Downhole impact generator 60 is illustrated as having been lowered into a well 68 on a conveyance 70 such as a wireline, a slickline, an electric line, a jointed tubing, a coiled tubing or the like but it is to be understood that downhole impact generator 60 may be collocated relative to well tool 72 by other suitable means including autonomously via a downhole robot.

In the illustrated embodiment, downhole impact generator 60 has reached its target location in well 68 and has operably engaged a well tool 72 via a suitable means such as a pulling tool, a shifting tool, a blind box or the like. Well tool 72 is not part of the present invention but rather is the workpiece operated upon by the invention. As such, well tool 72 can be any device that has been installed in well 68 or any device that has become a fish within well 68 and is adapted to receive or is capable of being engaged by downhole impact generator 60. Examples of particular well tools 72 include plugs, locks, chokes, valves, sleeves and others devices used in any of the various operations of drilling, testing, completing or producing well 68.

Figure 2D:
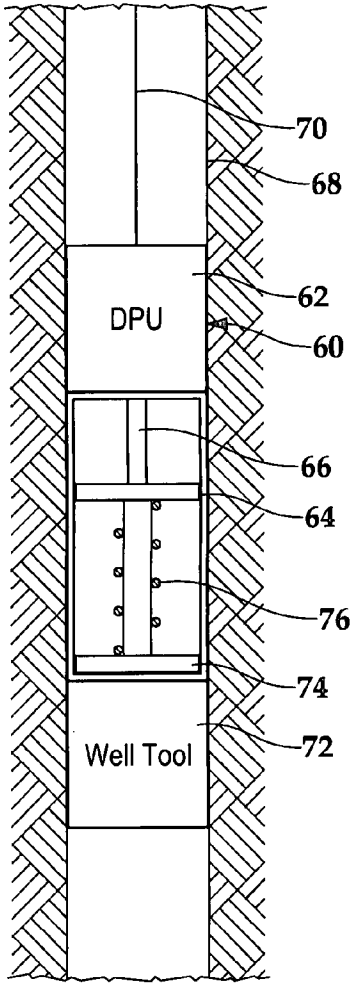
FIGS. 2A-2D are block diagrams of a downhole impact generator according to the present invention in its various operating positions being used to retrieve a well tool installed in a wellbore using downward jarring.
Figure 2C:
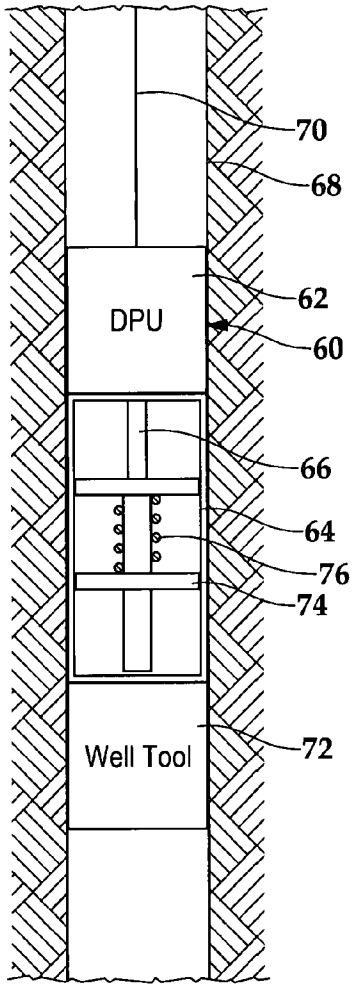
Figure 2B:
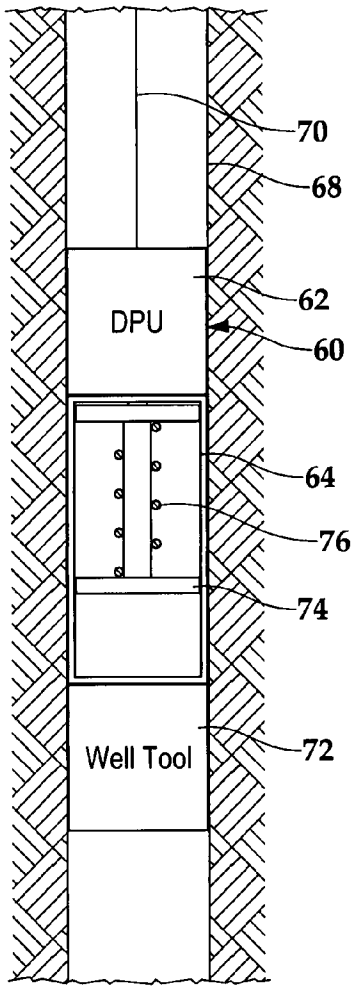
Figure 2A:
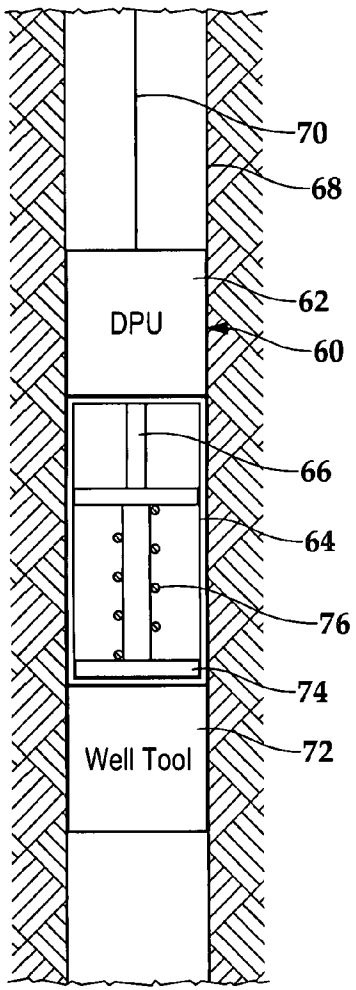

Once downhole impact generator 60 is collocated relative to well tool 72, operation of moveable shaft 66 of downhole power unit 62 is used to energize jarring tool 64. Specifically, in the illustrated embodiment, shaft 66 of downhole power unit 62 is moved upwardly which shifts anvil 74 of jarring tool 64 into its cocked position, as best seen in FIG. 2B. Shaft 66 of downhole power unit 62 is then moved downwardly to compress spring 76 of jarring tool 64 which stores energy therein, as best seen in FIG. 2C. Further downward movement of shaft 66 of downhole power unit 62 causes the release of anvil 74 which travels downwardly at high velocity and strikes the lower structure of jarring tool 74, as best seen in FIG. 2D. This impact transfers a downward jarring force to well tool 72. This process may be repeated as necessary by operating downhole power unit 62 and jarring tool 64 as described above until well tool 72 is dislodged from well 68. After well tool 72 is free, downhole impact generator 60 and well tool 72 may be retrieved to the surface if desired.

As will be described in more detail below, a particular implementation of downhole power unit 62 includes an elongated housing, a motor disposed in the housing and a sleeve connected to a rotor of the motor. The sleeve is a rotational member that rotates with the rotor. A moveable member such as moveable shaft 66 is received within the threaded interior of the sleeve. Operation of the motor rotates the sleeve which causes the moveable shaft 66 to move linearly.

In one embodiment, a microcontroller made of suitable electrical components to provide miniaturization and durability within the high pressure, high temperature environments which can be encountered in an oil or gas well is used to control the operation of downhole power unit 62. The microcontroller is preferably housed within the structure of downhole power unit 62, it can, however, be connected outside of downhole power unit 62 but within the tool string moved into well 68. In whatever physical location the microcontroller is disposed, it is operationally connected to downhole power unit 62 to actuate movement of the moveable shaft 66 when desired. In one embodiment, the microcontroller includes a microprocessor which operates under control of a timing device and a program stored in a memory. The program in the memory includes instructions which cause the microprocessor to control the downhole power unit 62.

The microcontroller operates under power from a power supply which can be at the surface of the well or contained within the microcontroller, downhole power unit 62 or otherwise within a downhole portion of the tool string of which these components are a part. For a particular implementation, the power source provides the electrical power to both the motor of downhole power unit 62 and the microcontroller. When downhole power unit 62 is at the target location, the microcontroller commences operation of downhole power unit 62 as programmed. For example, with regard to controlling the motor that operates the sleeve receiving moveable shaft 66, the microcontroller sends a command to energize the motor to rotate the sleeve in the desired direction to either extend or retract moveable shaft 66 at the desired speed and the desired distance. One or more sensors monitor the operation of downhole power unit 62 and provide responsive signals to the microcontroller. When the microcontroller determines that a desired result has been obtained, it stops operation of downhole power unit 62, such as by de-energizing the motor of the exemplified implementation. Alternatively, in a less complex implementation, the operation of downhole power unit 62 may be entirely controlled from the surface via one or more electrical or optical conductor cables carrying power, signal and control capabilities that are coupled to a surface control unit. This implementation can be particularly advantageous for operations that are expected to require multiple impacts to be generated by the downhole power unit as no preprogramming of a microcontroller is required.

Referring now to FIGS. 3A-3D, therein is schematically depicted downhole impact generator 60 of the present invention in an alternate configuration. Downhole impact generator 60 includes downhole power unit 62 and jarring tool 64. Downhole power unit 62 has moveable shaft 66 that is operably associated with and coupled to a portion of jarring tool 64. Downhole impact generator 60 is illustrated as having been lowered into a well 68 on a conveyance 70.

Figure 3D:
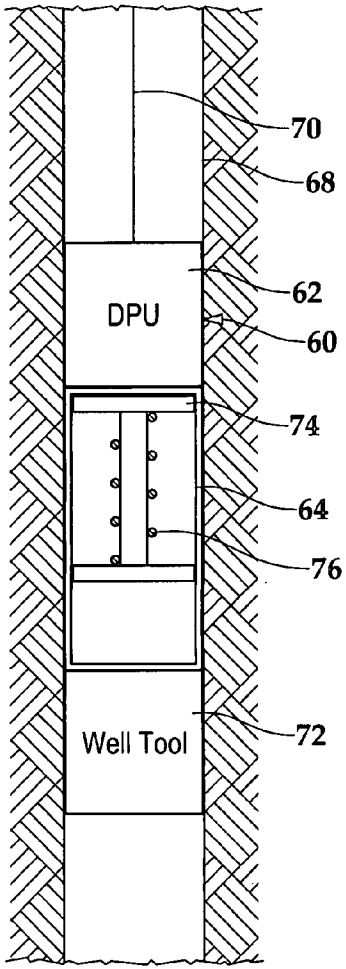
FIGS. 3A-3D are block diagrams of a downhole impact generator according to the present invention in its various operating positions being used to retrieve a well tool installed in a wellbore using upward jarring.
Figure 3C:
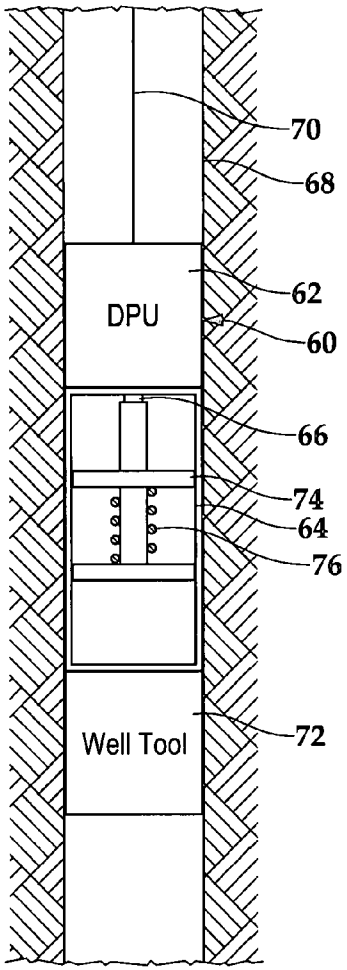
Figure 3B:
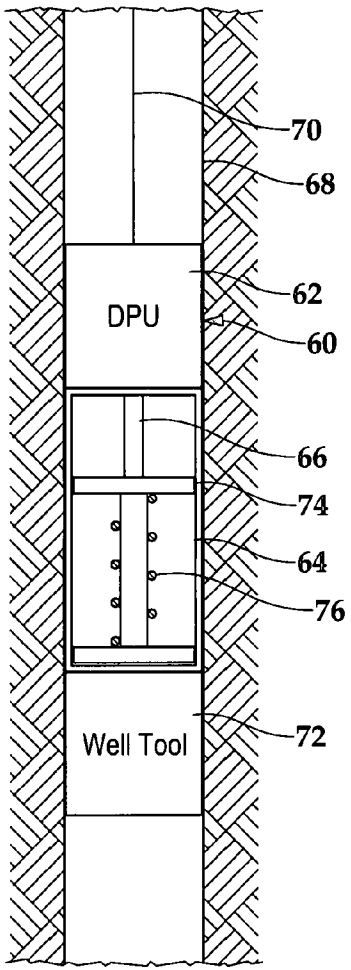
Figure 3A:
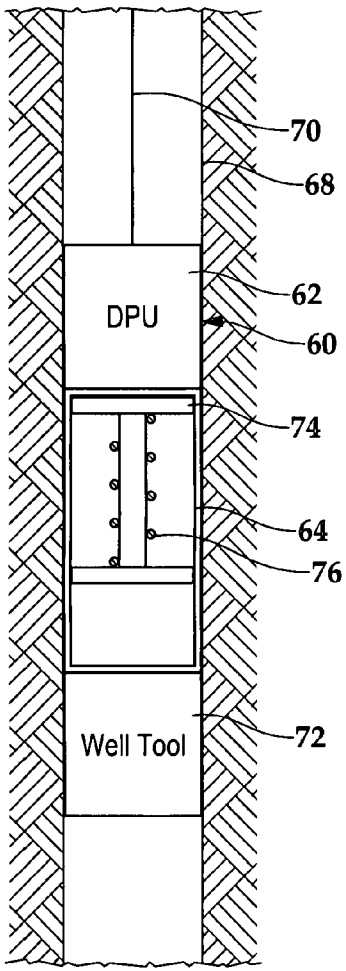

In the illustrated embodiment, once downhole impact generator 60 has reached its target location in well 68 and has engaged a well tool 72, operation of moveable shaft 66 of downhole power unit 62 is used to energize jarring tool 64. Specifically, in the illustrated embodiment, shaft 66 of downhole power unit 62 is moved downwardly which shifts anvil 74 of jarring tool 64 into its cocked position, as best seen in FIG. 3B. Shaft 66 of downhole power unit 62 is then moved upwardly to compress spring 76 of jarring tool 64 which stores energy therein, as best seen in FIG. 3C. Further upward movement of shaft 66 of downhole power unit 62 causes the release of anvil 74 which travels upwardly at high velocity and strikes the upper structure of jarring tool 74, as best seen in FIG. 3D. This impact transfers an upward jarring force to well tool 72. This process may be repeated as necessary by operating downhole power unit 62 and jarring tool 64 as described above until well tool 72 is dislodged from well 68. After well tool 72 is free, downhole impact generator 60 and well tool 72 may be retrieved to the surface if desired.

Referring now to FIGS. 4A-4D, therein is schematically depicted another embodiment of a downhole impact generator of the present invention that is generally designated 80. Downhole impact generator 80 includes a downhole power unit 82, an anchor 84 and a jarring tool 86. Downhole power unit 82 has a moveable member described herein as moveable shaft 88 that is operably associated with and coupled to a portion of jarring tool 86. Downhole impact generator 80 is illustrated as having been lowered into a well 90 on a conveyance 92. In the illustrated embodiment, downhole impact generator 80 has reached its target location in well 90 and has engaged a well tool 94. As stated above, the well tool is not part of the present invention but rather is the workpiece operated upon by the invention. In the illustrated embodiment, well tool 94 can be any device that is installed in well 90 that may be actuated from one operating position to another by a jarring force. Examples of particular well tools 94 include chokes, valves, sliding sleeves and the like used in any of the various operations of drilling, testing, completing or producing well 90.

Figure 4D:
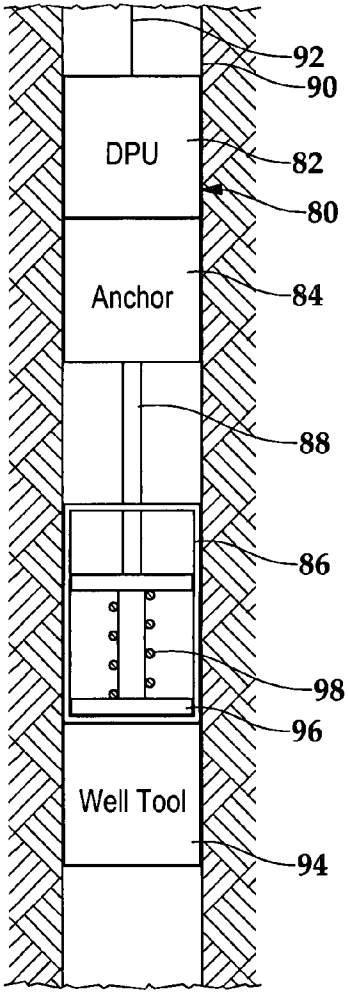
FIGS. 4A-4D are block diagrams of another embodiment of a downhole impact generator according to the present invention in its various operating positions being used to actuate a well tool installed in a wellbore using downward jarring.
Figure 4C:
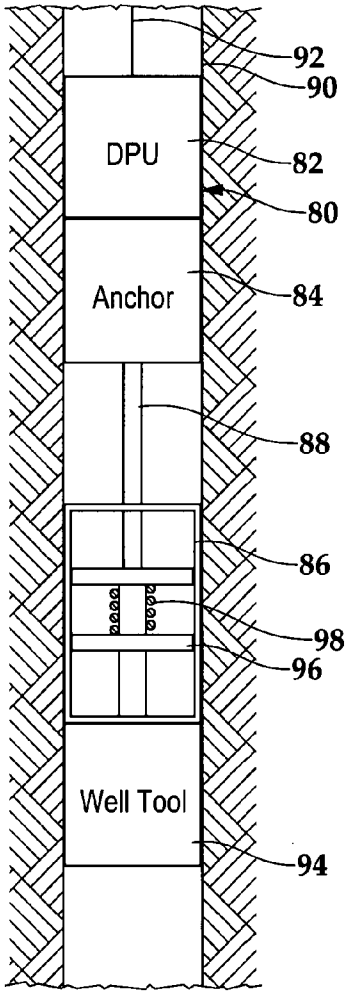
Figure 4B:
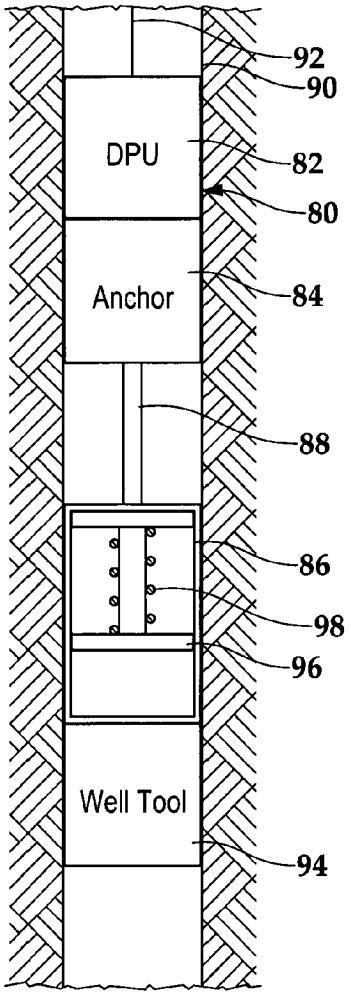
Figure 4A:
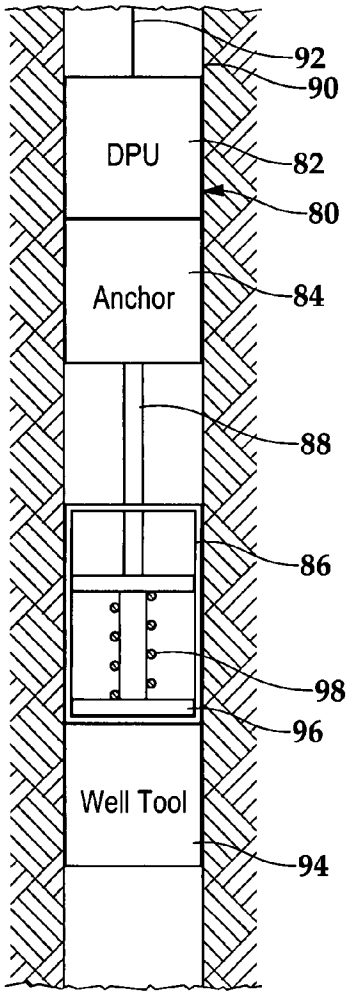

After downhole impact generator 80 has engaged well tool 94, downhole impact generator 80 is longitudinally secured within well 90 by operating anchor 84. Once downhole impact generator 80 is longitudinally secured and has engaged well tool 94, operation of moveable shaft 88 of downhole power unit 82 is used to energize jarring tool 86. Specifically, in the illustrated embodiment, shaft 88 of downhole power unit 82 is moved upwardly which shifts anvil 96 of jarring tool 86 into its cocked position, as best seen in FIG. 4B. Shaft 88 of downhole power unit 82 is then moved downwardly to compress spring 98 of jarring tool 86 which stores energy therein, as best seen in FIG. 4C. Further downward movement of shaft 88 of downhole power unit 82 causes the release of anvil 96 which travels downwardly at high velocity and strikes the lower structure of jarring tool 86, as best seen in FIG. 4D. This impact transfers a jarring force to well tool 94 such that well tool 94 is actuated from one operational state to another. After well tool 94 has been actuated, downhole impact generator 80 can be released from well tool 94 and well 90 for retrieval to the surface.

Figure 5:
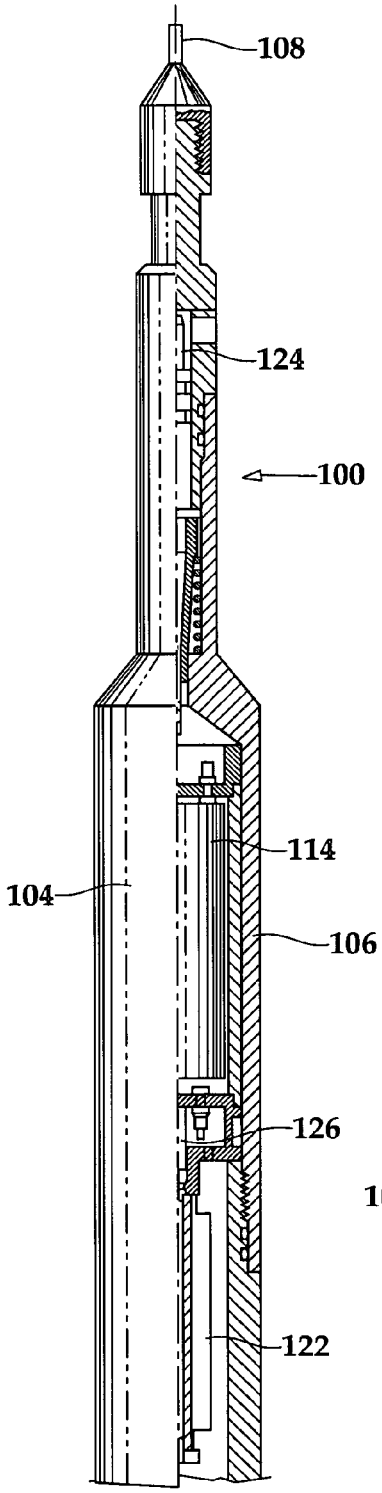
FIGS. 5-7 are quarter sectional views of successive axial sections of one embodiment of a downhole power unit of a downhole impact generator according to the present invention.
Figure 6:
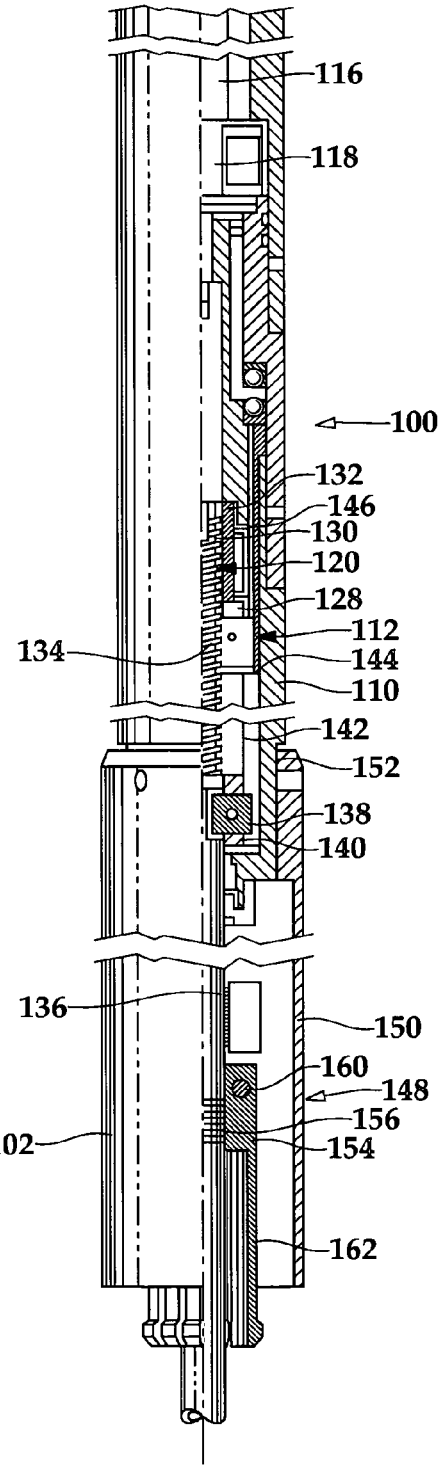
Figure 7:
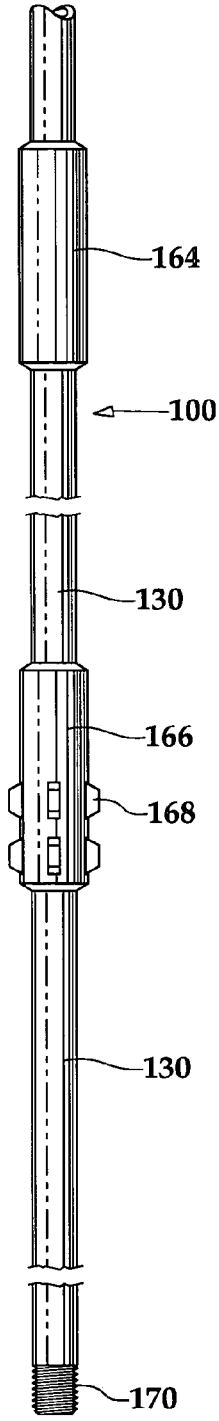

Referring next to FIGS. 5-7, therein is depicted successive axial sections of an exemplary downhole power unit that is generally designated 100 and that is capable of operations in the downhole impact generator of the present invention. Downhole power unit 100 includes a working assembly 102 and a power assembly 104. Power assembly 104 includes a housing assembly 106 which comprises suitably shaped and connected generally tubular housing members. An upper portion of housing assembly 106 includes an appropriate mechanism to facilitate coupling of housing 106 to a conveyance 108. Housing assembly 106 also includes a clutch housing 110 as will be described in more detail below, which forms a portion of a clutch assembly 112.

In the illustrated embodiment, power assembly 104 includes a self-contained power source that comprises a battery assembly 114 which may include a pack of twenty to sixty single use or rechargeable batteries such as alkaline or lithium batteries. In an alternate embodiment, downhole power unit 100 may receive electrical energy from the surface via an electric line, in which case, battery assembly 114 is optional.

Connected with power assembly 104 is the force generating and transmitting assembly. The force generating and transmitting assembly of this implementation includes a direct current (DC) electric motor 116, coupled through a gearbox 118, to a jackscrew assembly 120. A plurality of activation mechanisms 122, 124 and 126, as will be described, can be electrically coupled between battery assembly 114 and electric motor 116. Electric motor 116 may be of any suitable type. One example is a motor operating at 7500 revolutions per minute (rpm) in unloaded condition, and operating at approximately 5000 rpm in a loaded condition, and having a horsepower rating of approximately 1/30th of a horsepower. In this implementation, motor 116 is coupled through the gearbox 118 which provides approximately 5000:1 gear reduction. Gearbox 118 is coupled through a conventional drive assembly 128 to jackscrew assembly 120.

The jackscrew assembly 120 includes a threaded shaft 130 which moves linearly, rotates or both, in response to rotation of a sleeve assembly 132. Threaded shaft 130 includes a threaded portion 134, and a generally smooth, polished lower extension 136. Threaded shaft 130 further includes a pair of generally diametrically opposed keys 138 that cooperate with a clutch block 140 which is coupled to threaded shaft 130.

Clutch housing 110 includes a pair of diametrically opposed keyways 142 which extend along at least a portion of the possible length of travel. Keys 138 extend radially outwardly from threaded shaft 130 through clutch block 140 to engage each of keyways 142 in clutch housing 110, thereby selectively preventing rotation of threaded shaft 130 relative to housing 110.

Rotation of sleeve assembly 132 in one direction causes threaded shaft 130 and clutch block 140 to move linearly upwardly relative to housing assembly 110 if shaft 130 is not at its uppermost limit. Rotation of the sleeve assembly 132 in the opposite direction moves shaft 130 linearly downwardly relative to housing 110 if shaft 130 is not at its lowermost position. Above a certain level within clutch housing 110, as indicated generally at 144, clutch housing 110 includes a relatively enlarged internal diameter bore 146 such that moving clutch block 140 above level 144 removes the outwardly extending key 138 from being restricted from rotational movement. Accordingly, continuing rotation of sleeve assembly 132 causes linear movement of threaded shaft 130 until clutch block 140 rises above level 144, at which point rotation of sleeve assembly 132 will result in free rotation of threaded shaft 130. By virtue of this, clutch assembly 112 serves as a safety device to prevent burn-out of the electric motor, and also serves as a stroke limiter. In a similar manner, clutch assembly 112 may allow threaded shaft 130 to rotation freely during certain points in the linear travel of threaded shaft 130.

In the illustrated embodiment, downhole power unit 100 incorporates three discrete activation assemblies, separate from or part of the microcontroller discussed above. The activation assemblies enable jackscrew 120 to operate upon the occurrence of one or more predetermined conditions. One depicted activation assembly is timing circuitry 122 of a type known in the art. Timing circuitry 122 is adapted to provide a signal to the microcontroller after passage of a predetermined amount of time. Further, downhole power unit 100 can include an activation assembly including a pressure-sensitive switch 124 of a type generally known in the art which will provide a control signal once the switch 124 reaches a depth at which it encounters a predetermined amount of hydrostatic pressure within the tubing string. Still further, downhole power unit 100 can include a motion sensor 126, such as an accelerometer or a geophone that is sensitive to vertical motion of downhole power unit 100. Accelerometer 126 can be combined with timing circuitry 122 such that when motion is detected by accelerometer 126, timing circuitry 122 is reset. If so configured, the activation assembly operates to provide a control signal after accelerometer 126 detects that downhole power unit 100 has remained substantially motionless within the well for a predetermined amount of time. In the embodiment of downhole power unit 100 wherein electrical power is provided from the surface, the activation assemblies described above are optional as the operation of downhole power unit 100 may be surface controlled.

Working assembly 102 includes an actuation assembly 148 which is coupled through housing assembly 106 to be movable therewith. Actuation assembly 148 includes an outer sleeve member 150 which is threadably coupled at 152 to housing assembly 106. Working assembly 102 also includes a connecting sub 154 which is releasably coupled at threaded connection 156 to a portion of polished extension 136 of threaded shaft 130 which allows for the disconnection of threaded shaft 130 from connecting sub 154 upon application of a predetermined axial force. Connecting sub 154 facilitates connecting downhole power unit 100 to an anchor as will be described below. Specifically, connecting sub 154 is coupled to the anchor through pins 160 and collet member 162.

Threaded shaft 130 includes a radially enlarged region 164 that interacts with collet member 162 when it is desired to release the anchor from the well as will be described below. Threaded shaft 130 also includes a radially enlarged region 166 having locating keys 168 that interacts with the anchor when it is desired to release the anchor from the well as will be described below. The lower end 170 of threaded shaft 130 has a threaded coupling that allows for the coupling of downhole power unit 100 to a jarring tool as will be described below.

Even though a particular embodiment of a downhole power unit has been depicted and described, it should be clearly understood by those skilled in the art that other types of downhole power devices could alternatively be used with the downhole impact generator of the present invention such that the downhole impact generator of the present invention may exert a jarring force on a well tool positioned within the wellbore.

Figure 8:
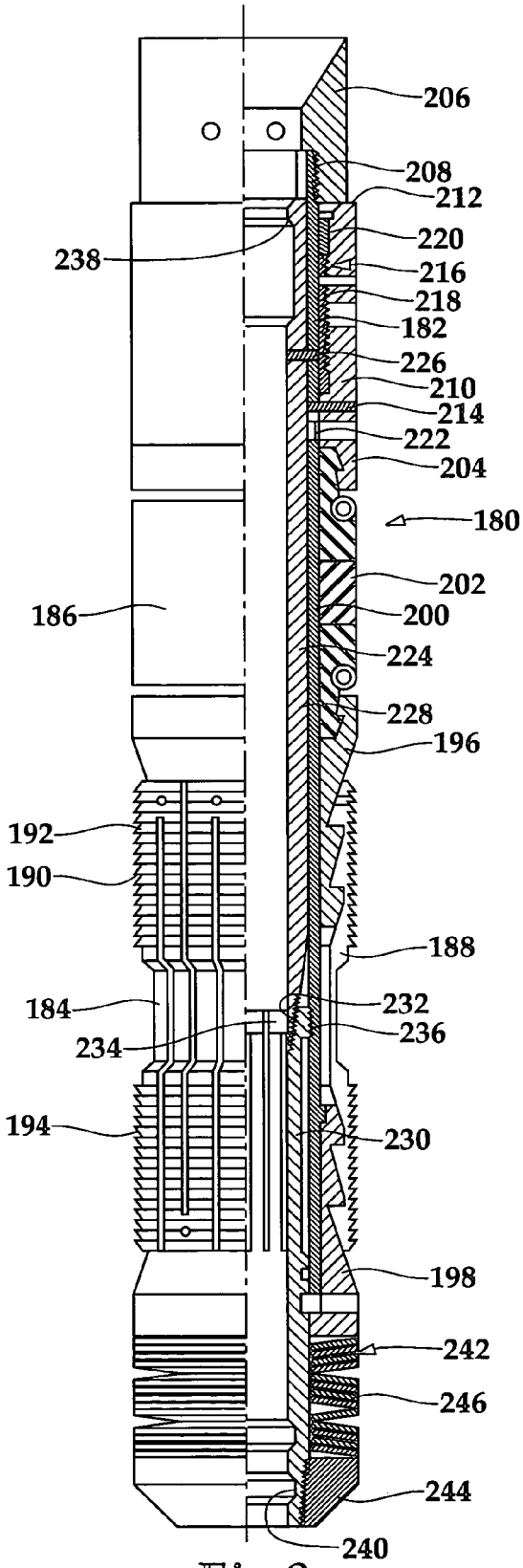
FIG. 8 is a quarter sectional view of one embodiment of an anchor of a downhole impact generator according to the present invention.

Referring now to FIG. 8, therein is shown an exemplary anchor that is generally designated 180 and that is capable of operations in the downhole impact generator of the present invention. It should be noted that threaded shaft 130 of downhole power unit 100 passes through a central bore of anchor 180 as will be described in greater detail below. Anchor 180 has a support mandrel assembly 182, which supports a barrel slip assembly 184. Barrel slip assembly 184 is operable between a reduced diameter condition by which anchor 180 may be placed into or removed from a tubular string and an expanded diameter condition by which barrel slip assembly 184 is set and mechanically engages the tubular string such that the downhole impact generator of the present invention is longitudinally secured within the tubular string. In the illustrated embodiment, anchor 180 also includes a packing assembly 186 which is also movable between a relatively reduced diameter condition, and a relatively expanded diameter condition whereby packing assembly 186 sealingly engages the interior of the tubular string.

Barrel slip assembly 184 preferably includes a one-piece slip body 188 which surrounds a portion of anchor 180 in a circumferentially continuous manner, such that slip body 188 is unbroken at any point around the anchor 180. Slip body 188 comprises a plurality of anchoring slips 190 which are configured to be radially expansible. Each anchoring slip 190 is preferably provided with opposing sets of anchoring teeth 192, 194 upon longitudinally opposed portions of its exterior surface which are adapted to mechanically engage the interior surface of a tubular string when barrel slip assembly 184 is set. Opposed anchoring teeth 192, 194 are each directional to resist axial movement of anchor 180, within the tubular string in either axial direction.

Barrel slip assembly 184 further includes an actuation assembly which includes upper and lower annular wedge assemblies 196, 198 which are adapted to be longitudinally movable relative to each other along an outer mandrel 200. Slip body 188 is configured to engage and cooperate with wedge assemblies 196, 198 in such a manner that converging longitudinal movement of annular wedge assemblies 196, 198 causes radial expansion of slip body 188 by urging anchoring slips 190 radially outwardly.

Annular packing assembly 186 has a substantially elastomeric sleeve 202 which is also operable between an expanded diameter condition and a reduced diameter condition by virtue of axial compression. Annular packing assembly 186 is concentrically disposed relative to outer mandrel 200, of support mandrel assembly 182, and is disposed at a relatively uphole position relative to barrel slip assembly 184. Compressional force may be applied to elastomeric sleeve 202 between annular wedge assembly 196 and retaining member 204.

Outer mandrel 200 of anchor 180 extends through barrel slip assembly 184 and packing assembly 186 in a generally coaxial relation therewith. A generally annular engagement member 206 is attached by a threaded coupling 208, or other attachment mechanism, to outer mandrel 200 proximate the upper end thereof. Engagement member 206 is adapted to be coupled to downhole power unit 100 described above via its connecting sub 154 and specifically, through pins 160 and collet member 162 of connecting sub 154 of downhole power unit 100.

The actuation assembly of anchor 180 includes an axial compression member 210 that is disposed around an upper portion of outer mandrel 200. Axial compression member 210 defines a radially extending actuation surface 212 which engages outer sleeve member 150 of actuation assembly 148 downhole power unit 100. One or more shear pins 214 are provided to resist motion of compression member 210 with respect to mandrel 200. A motion restricting assembly 216 is operatively coupled to axial compression member 210 to allow movement of axial compression member 210 in only a downward direction relative to outer mandrel 200. In the illustrated embodiment, motion restriction assembly 216 includes a threaded ring 218 and a split-ring 220 which associate axial compression member 210 with outer mandrel 200.

Split ring 220 is adapted to be movable axially along mandrel 200 during setting of anchor 180 and will engage recess 222 of outer mandrel 200 during removal operations. Engagement of split ring 220 with annular recess 222 provides a positive lock of compression member 210 relative to outer mandrel 200.

Anchor 180 further includes a release mandrel assembly 224 disposed within outer mandrel 200 in a generally coaxial relation therewith. One or more shear pins 226 may be placed through portions of release mandrel assembly 224 and outer mandrel 200 to resist axial displacement between the mandrels. Release mandrel assembly 224 is axially extensible in response to diverging axial tension applied proximate its axial ends. In a preferred embodiment, release mandrel 224 includes an upper section 228 and a lower section 230, which are coupled to one another by a selectively releasable connection, such as a threaded connection 232. Releasable threaded connection 232 is configured to release under diverging axial tension of a generally predetermined magnitude applied across upper section 228 and lower section 230 of release mandrel assembly 224, such that the sections separate and become axially spaced from each other. In this preferred embodiment, releasable threaded connection 232 is formed through use of a plurality of threaded collet fingers 234 in lower section 230 of release mandrel assembly 224. Other extensible designs for release mandrel 224 may, of course be contemplated, such as shearable telescoping configurations.

A threaded connection 236 may also be provided between collet fingers 234 on lower half 230 of release mandrel assembly 224 and outer mandrel 200. Threaded connection 236 is adapted to maintain a fixed relation between lower section 230 and outer mandrel 200 when upper and lower sections 228, 230 are engaged. Threaded connection 236 will also be severable under divergent axial tension as upper and lower sections 228, 230 are separated.

Upper releasable mandrel section 228 includes an internal generally annularly extending actuation surface 238 proximate its upper end. Similarly, lower releasable mandrel section 230 includes an internal, generally annular, actuation surface 240. Annular actuation surfaces 238, 240 on upper and lower releasable mandrel sections 228, 230 facilitate engagement with a downhole power unit 100, by providing surfaces for receiving the application of divergent axial tension across releasable mandrel 224 to cause the releasing of threaded connections 232, 236.

Anchor 180 further includes a spring assembly 242, which includes one or more springs disposed around lower section 230 of release mandrel 224. The lower end of spring assembly 242 is secured to the release mandrel 224 by a retaining ring 244 which is preferably threadably coupled to lower section 230. Springs 246 are adapted to store energy resulting from the axial compression of portions of anchor 180 when anchor 180 is set. Telescoping of compression member 210 relative to outer mandrel 200, will cause radial expansion of elastomeric sleeve 202, setting of barrel slip assembly 184 and compression of springs 246.

Even though a particular embodiment of an anchor has been depicted and described, it should be clearly understood by those skilled in the art that other types of anchoring devices could alternatively be used for longitudinally securing the downhole impact generator of the present invention within a wellbore such that the downhole impact generator of the present invention may exert a jarring force on a well tool positioned within the wellbore.

Figure 9:
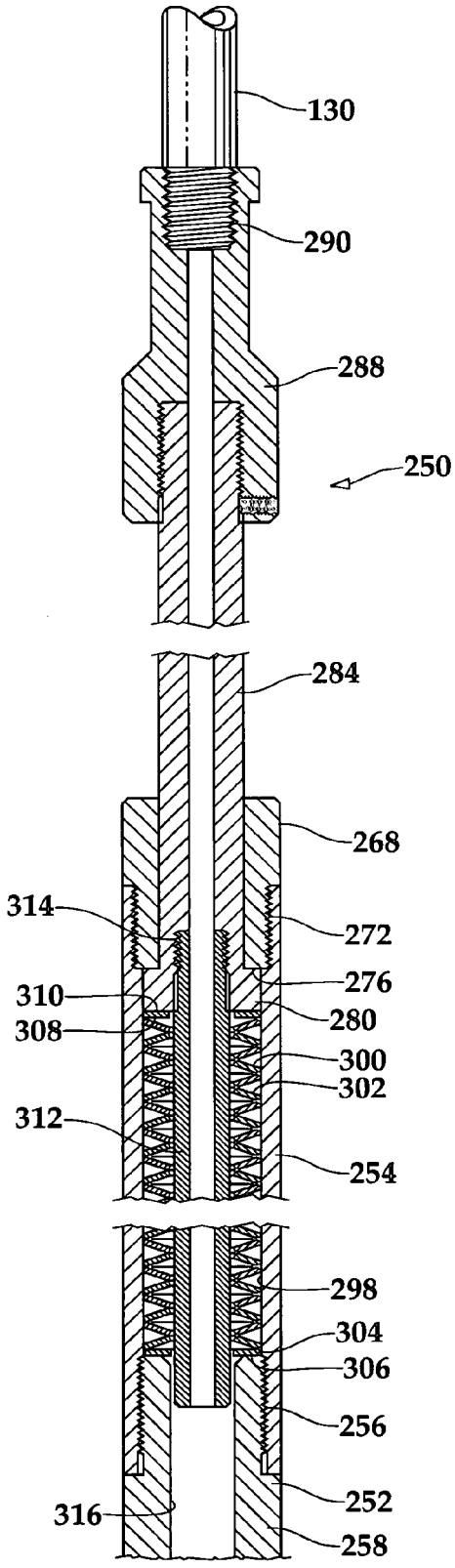
FIGS. 9-11 are cross sectional views of successive axial sections of one embodiment of a jarring tool of a downhole impact generator according to the present invention.
Figure 10:
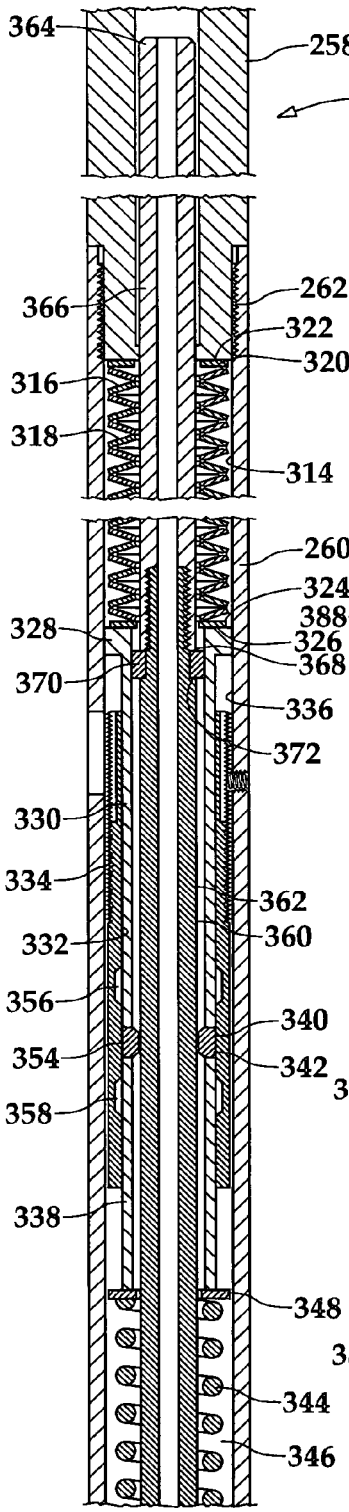
Figure 11:
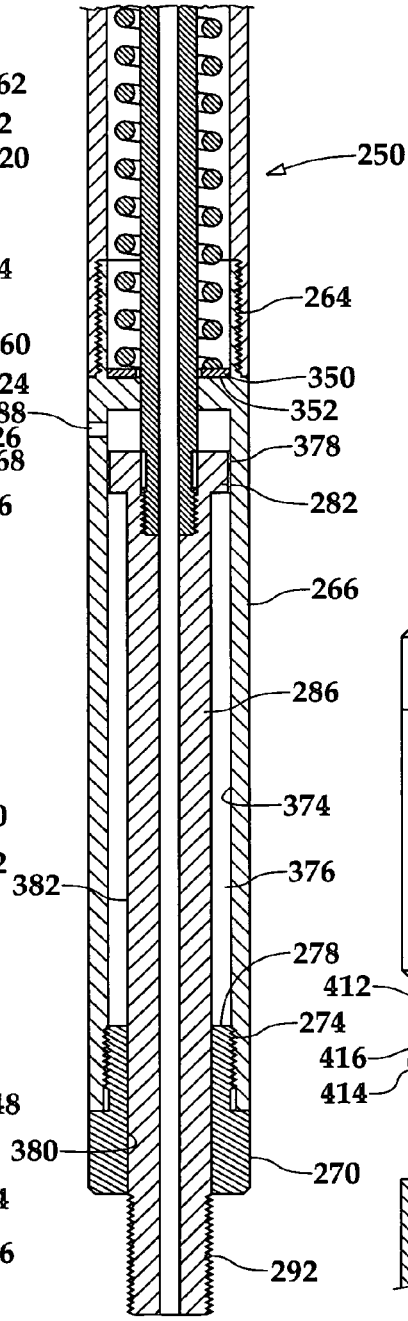
Figure 12:
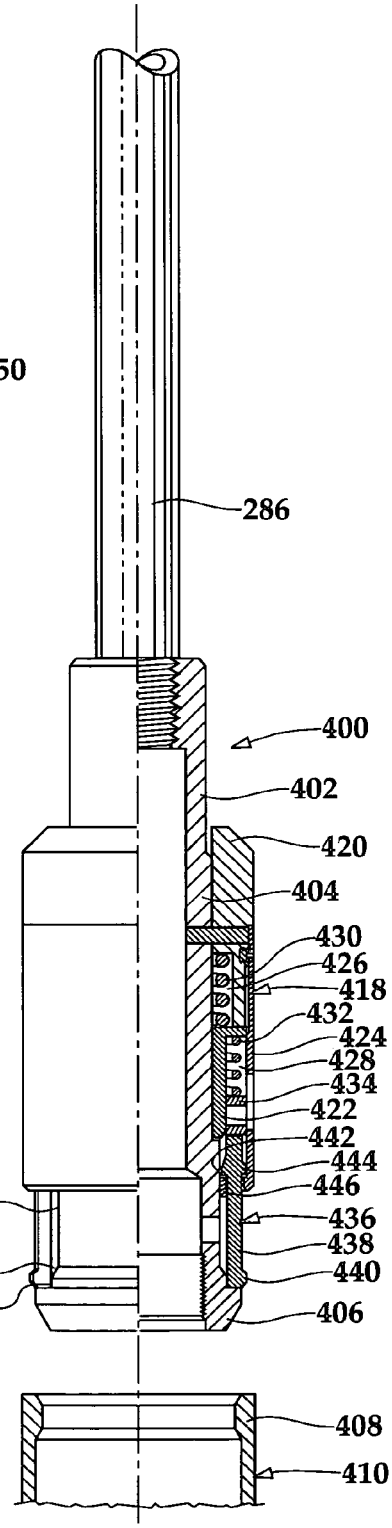
FIG. 12 is a quarter sectional view of one embodiment of a pulling tool of a downhole impact generator according to the present invention.

Referring now to FIGS. 9-11, therein is shown successive axial sections of an exemplary jarring tool that is generally designated 250 and that is capable of operations in the downhole impact generator of the present invention. Jarring tool 250 has a generally tubular outer housing 252 which is formed by an upper housing section 254 having threaded connection at 256 with a housing spacer 258. Housing 252 also has an intermediate housing section 260 having a threaded connection at 262 with the housing spacer 258 and having at its lower end, a threaded connection at 264 with a lower housing section 266. Housing 252 also includes at its upper end an upper anvil cap 268 and at its lower end a lower anvil cap 270 having threaded connection respectively at 272 with the upper housing section 254 and at 274 with the lower housing section 266. Anvil caps 268, 270 each define inwardly directed force transmission shoulders 276, 278 respectively for impact by impact hammers 280, 282 which are defined by enlargements at the inner extremities of upper and lower telescoping mandrels 284, 286. Upper mandrel 284 is threadedly secured to a top sub 288 having a threaded connection 290 that may be utilized to receive lower end 170 of threaded shaft 130 of downhole power unit 100 as depicted or another similar or identical jarring tool if desired. Lower mandrel 286 has a threaded connection 292 that may be utilized to couple to a pulling tool as depicted in FIG. 12 or another similar or identical jarring tool if desired.

Positioned within upper housing section 254 is an internal compressive load delivery system that may be generally referred to as an inverted accelerator. Specifically, upper housing section 254 defines an internal spring chamber 298 having a compression spring system 300 disposed therein. In the illustrated embodiment, spring system 300 includes a spring stack of suitable height which is defined by a plurality of Belleville springs 302. The lower end of compression spring system 300 is supported by a force transmission washer 304 which bears against an upwardly directed thrust shoulder 306 formed by the upper end of housing spacer 258. The upper end of compression spring system 300 bears against a thrust washer 308 which in turn bears against a downwardly directed thrust shoulder 310 of mandrel 284. Compression spring system 300 is maintained in alignment by means of a tubular spring guide element 312 which is threadedly connected at 314 within the lower end of upper mandrel 284. At the maximum expanded condition of compression spring system 300, the lower end of tubular spring guide 312 will be located within the upper end of an internal alignment passage 316 of housing spacer 258. Thus, at all positions of telescoping upper mandrel 284, compression spring system 300 remains adequately guided and centered by tubular spring guide 312.

Jarring tool 250 defines a load delivery system for jarring with significant force and also defines a latch mechanism or firing mechanism for releasing the sudden downwardly directed load delivery system when a predetermined downward force has been applied to jarring tool 250. Intermediate housing section 260 forms an internal spring chamber 314 within which is received a compression spring assembly 316 which will preferably incorporate a plurality of Belleville springs 318 having the capability of storing sufficient mechanical energy to deliver the load of jarring tool 250. Compression spring assembly 316 is also referred to herein as load spring 316.

The upper end of compression spring assembly 316 bears against a spacer thrust washer 320 which in turn engages an internal thrust shoulder 322 defined by the lower end of housing spacer 258. In the illustrated embodiment, compression spring assembly 316 incorporates heavy-duty Belleville springs along most of its length and employs lighter weight Belleville springs at its upper extremity. This feature ensures that compression spring assembly 316 is capable of delivering sufficient force for efficient down jarring activity of high magnitude and also insures that the firing mechanism of jarring tool 250 will have ample linear movement for efficiency of control and firing.

The lower end of compression spring assembly 316 engages a lower thrust washer 324 which is seated against a circular thrust shoulder 326 formed by a circular enlargement 328 at the upper end of a tubular upper spacer 330. The outer cylindrical surface of upper spacer 330 is received in close fitting relation guided within a cylindrical bore 332 defined by tubular detent body 334. Detent body 334 thus functions as a guide to maintain upper spacer 330 properly positioned within housing 252. The large diameter upper end 328 of upper spacer 330 also defines a circular outer peripheral surface having guided relation with inner cylindrical surface 336 of intermediate housing section 260.

The firing mechanism of jarring tool 250 includes a lower tubular spacer member 338 which is disposed for linear movement within intermediate housing section 260 and is positioned and guided by inner cylindrical surface 332 of detent body 334. A firing lug assembly 340 is composed of a plurality of firing lug segments 342 and is positioned between the lower end of upper spacer member 330 and the upper end of lower spacer member 338. The upper and lower spacers cooperate to secure firing lug segments 342 against linear movement except as permitted by simultaneous movement thereof along with upper and lower spacer members 330, 338.

Lower spacer member 338 is urged against firing lug assembly 340 by means of a recock compression spring 344 which is maintained within a spring chamber 346. The upper end of recock compression spring 344 bears against a thrust washer 348 seated at the lower end of lower spacer 338. The lower end of the recock compression spring 344 bears against a thrust washer 350 which is supported by a circular thrust shoulder 352 forming the lower end of spring chamber 346.

Firing lug assembly 340 is normally provided with external support against outward radial movement by means of a support land 354 which is formed by cylindrical surface 332 between internal firing detent groove 356 and internal recocking groove 358. Each of the grooves 356, 358 define upper and lower tapered surfaces which establish a camming relationship between the firing ring and firing lug assembly 340 which, in response to a linear load, imparts radially outward force movements to each of the firing lugs 342. While firing groove 356 and recocking groove 358 permit radial expansion of the firing lug assembly 340 when upper and lower spacers 330, 338 are sufficiently moved in linear manner, the tapered groove shoulders function to achieve radial contraction of firing lug assembly 340 as upper and lower spacers 330, 338 shift the firing lug assembly 340 from the respective firing groove 356 or recocking groove 358 to support land 354 as best seen in FIGS. 13-16 and which will be described in greater detail below.

When in position, the respective firing lug segments 342 tend to remain in assembly by virtue of their wedge-shaped configuration as they can only contract radially inwardly sufficiently that their tapered side surfaces come into contact. When firing lug assembly 340 is restrained against radially outward movement by support land 354, they are also restrained against excessive radially inward movement by the cylindrical outer surface 360 of spring guide member 362. Spring guide member 362 is of sufficient length that its free extremity 364 is positioned within cylindrical passage 316 of housing spacer 258 even when compression spring assembly 316 has expanded to its maximum length. Spring guide member 362 is secured by a threaded connection to an elongate firing ring positioning element 366 and functions to provide a circular locking shoulder 368 at the lower end thereof that secures a circular firing ring 370 in locked position against a circular, upwardly facing shoulder 372 of spring guide member 362. Firing ring 370 is thus secured in fixed relation with spring guide element 362 and firing ring positioning element 366. Firing ring 370 is also fixed relative to lower mandrel 286 due to the treaded connection between spring guide member 362 and lower mandrel 286 so that housing 252 and detent body 334 are movable with respect to firing ring 370 during both the firing and recocking strokes thereof. Upper and lower spacers 330, 338 and firing lug assembly 340 are also linearly movable relative to firing ring 370.

Lower housing section 266 forms an inner cylindrical surface 374 which defines an elongate chamber 376 within which the upper end of the lower telescoping mandrel 286 is movably received. Circular enlargement 282 at the upper end of lower mandrel 286 defines an outer cylindrical guide surface 378 having close fitting guided relation with the inner cylindrical surface 374. Lower anvil cap 270 also defines an internal cylindrical guide surface 380 having close fitting guided relation with outer cylindrical surface 382 of lower mandrel 286. Lower housing section 266 is thus efficiently guided by the close fit between lower anvil cap 270 and lower mandrel 286.

Spring guide member 362 has its lower end fixed to the upper end of the lower mandrel 286 by means of a threaded connection. A set screw (not pictured) may be used to secure lower mandrel 286 and spring guide member 362 against relative rotation and inadvertent disassembly. Lower housing section 266 is provided with a port 388 that allows rapid egress of fluid from within chamber 376 upon firing of jarring tool 250. This feature prevents any degree of hydraulic resistance from interfering with the force transmitted by jarring tool 250 during jarring activity.

Even though a particular embodiment of a jarring tool has been depicted and described, it should be clearly understood by those skilled in the art that other types of jarring devices could alternatively be used for generating an impact within the downhole impact generator of the present invention such that the downhole impact generator of the present invention may exert a jarring force on a well tool positioned within the wellbore. Such jarring tools include, but are not limited to, up jarring tools, bidirectional jarring tool, hydraulic jarring tools, double acting jarring tools and the like.

Referring now to FIG. 12, therein is depicted an exemplary pulling tool that is generally designated 400 and that is capable of operations in the downhole impact generator of the present invention. Pulling tool 400 is depicted as being coupled to the end of lower mandrel 286 of jarring tool 250.

Pulling tool 400 has a latching mandrel 402 that includes a reduced diameter portion 404 and a beveled fishing nose 406 for facilitating its engagement with a fishing neck 408 of a well tool 410 at the target location. The latching mandrel 402 further includes a reduced diameter portion 412 and an increased diameter portion 414 having a ramp portion 416 therebetween. The increased diameter portion 414 is positioned adjacent fishing nose 406 of latching mandrel 402.

A tubular housing 418 is disposed over latching mandrel 402. Housing 418 includes an upper housing member 420, a lower housing member 422 and an outer housing member 424. Housing 418 also has two internal bores 426, 428. A compression spring 430 is disposed in internal bore 426 between upper housing member 420 and lower housing member 422 to urge upper housing member 420 in a direction away from lower housing member 422. A compression spring 432 and a retaining ring 434 are disposed in internal bore 428. Compression spring 432 is disposed between a shoulder of lower housing member 422 and retaining ring 434 to urge upper retaining ring 434 in a direction toward fishing nose 406 of the latching mandrel 402.

Pulling tool 400 includes a latching assembly 436 for automatically latching mandrel 402 of pulling tool 400 to fishing neck 408 of well tool 410 when fishing nose 406 of pulling tool 400 engages fishing neck 408. The portion of latching assembly 436 which provides the capability of latching pulling tool 400 to fishing neck 408 includes a plurality of latching members 438 which are spaced around the outer surface of latching mandrel 402. Latching members 438 are slidably positioned on latching mandrel 402 and extend in a direction parallel to the axis of pulling tool 400. Each of the latching members 438 has an enlarged end portion 440 which normally engages increased diameter portion 414 of latching mandrel 402. The ends of latching members 438 opposite the enlarged end portions 440 contact retaining ring 434. Each of the latching members 438 includes an enlarged inner portion 442 and an enlarged outer portion 444. Enlarged inner portion 442 includes a ramp portion and a shoulder that contacts a stop 446 when latching members 438 are urged to their lowermost position by compression spring 432. Enlarged outer portion 444 forms an external shoulder that is positioned within outer housing 424.

Even though a particular embodiment of a pulling tool has been depicted and described, it should be clearly understood by those skilled in the art that other types of pulling tools, such as spears, overshots and the like could alternatively be used with the downhole impact generator of the present invention such that the downhole impact generator of the present invention may be coupled to and exert a jarring force on a well tool positioned within the wellbore.

An exemplary deployment and retrieval of the downhole impact generator of the present invention will now be described with reference to FIG. 5-16, collectively. If it becomes necessary to retrieve a stuck well tool that was previously installed in a wellbore, the downhole impact generator of the present invention is run downhole on a conveyance to the target location. As will be understood by those skilled in the art, depending upon the specifics of the operation to be performed by the downhole impact generator of the present invention, the downhole impact generator may be longitudinally secured relative to the well tool by virtue of a coupling therebetween as described above with reference to FIGS. 2A-3D or may be anchored within the wellbore as described above with reference to FIGS. 4A-4D and hereinbelow.

Once the downhole impact generator of the present invention is at the target location, pulling tool 400 is operably engaged with well tool 410. Specifically, fishing nose 406 of latching mandrel 402 engages fishing neck 408 of well tool 410. As fishing nose 406 moves into fishing neck 408, the ramp portions of enlarged end portions 440 of latching members 438 first engage complimentary ramp portions within fishing neck 408 such that latching members 438 and retaining ring 434 are pushed against spring 432. Spring 432 is compressed which allows latching members 438 to be moved away from fishing nose 406 whereby enlarged end portions 440 of latching members 438 are moved from increased radius portion 414 of latching mandrel 402 up ramp portion 416 and onto reduced radius portion 412. This allows enlarged end portions 440 of latching members 438 to move past the enlarged inwardly extending complimentary portion of fishing neck 408 to a position within fishing neck 408. Once enlarged end portions 440 of latching members 438 pass the enlarged inwardly extending portion of fishing neck 438, spring 432 moves retaining ring 434 and latching members 438 in the opposite direction such that enlarged end portions 440 of latching members 438 are moved back to their outward engaging position whereby latching members 438 are resting on surface 414 of latching mandrel 402. Once pulling tool 400 has operably engaged well tool 410, jarring force applied to pulling tool 400 by jarring tool 250 will be transmitted to well tool 410 to dislodge well tool 410 for the wellbore for retrieval.

Continuing with the exemplary deployment, once pulling tool 400 has operably engaged well tool 410, the downhole impact generator of the present invention is anchored within the wellbore. As described above, downhole power unit 100 is adapted to cooperate with anchor 180. Specifically, prior to run in, engagement member 206 of anchor 180 is coupled with connecting sub 154 of downhole power unit 100 through pins 160. In addition, collet member 162 of connecting sub 154 of downhole power unit 100 is positioned adjacent to annular actuation surface 238 on upper releasable mandrel sections 228. In this configuration, linear movement of threaded shaft 130 of downhole power unit 100 moves packing assembly 186 and barrel slip assembly 184 from their reduced diameter conditions to their expanded diameter conditions by engagement of outer sleeve 150 of downhole power unit 100 with axial compression member 210 of anchor 180. This linear movement exerts an axial force upon compression member 210 due to the downward axial movement of outer member 150 with respect to anchor 180. Accordingly, as will be appreciated from the above discussion, actuation of motor 116 by activation assemblies 122, 124, 126, and the resulting linear movement of threaded screw 134 will cause a relative downward movement of outer sleeve 150 relative to anchor 180. This relative downward movement will break shear pins 214 securing compression member 210 in an initial, unactuated, position relative to support mandrel assembly 182 and will thereby cause the previously described radial expansion of elastomeric sleeve 202, setting of barrel slip assembly 184 and compression of springs 246. Once anchor 180 is in this set configuration, the downhole impact generator of the present invention is anchored and longitudinally secured within the wellbore.

Figure 13:
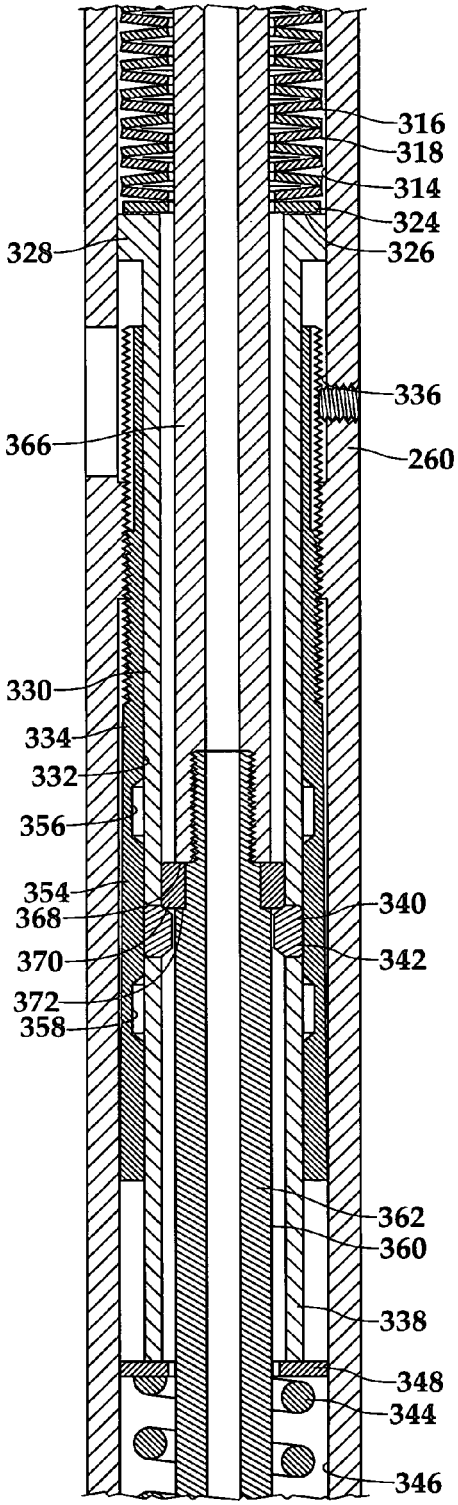
FIGS. 13-16 are cross sectional views of a portion of one embodiment of a jarring tool of a downhole impact generator according to the present invention in its various operating positions.
Figure 14:
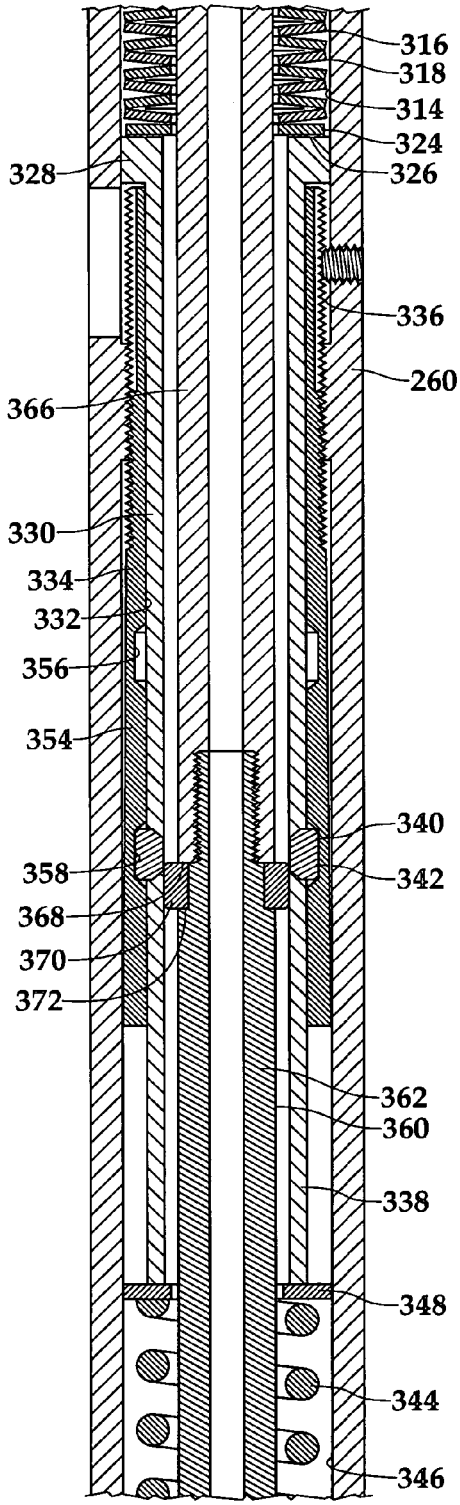
Figure 15:
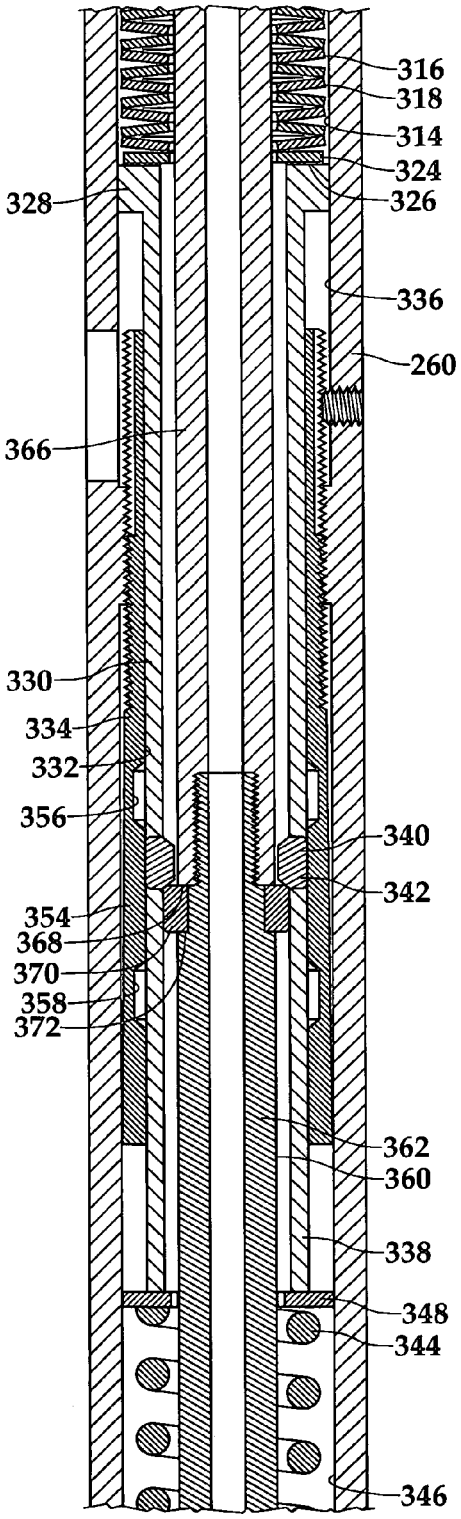
Figure 16:
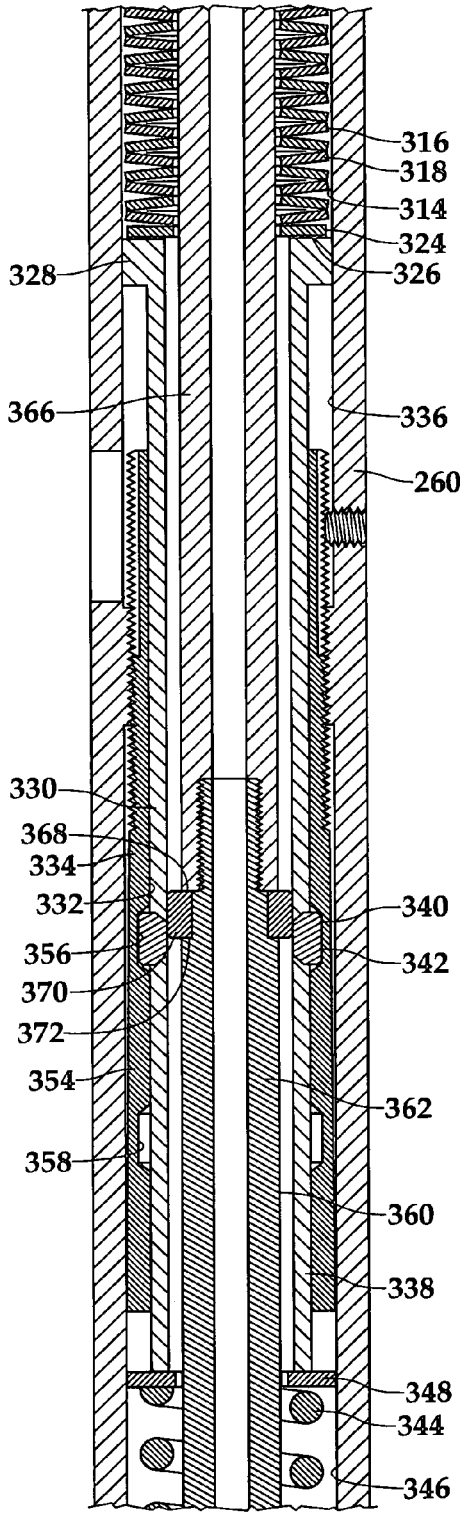

Once the downhole impact generator of the present invention is anchored within the wellbore, continued linear movement of threaded shaft 130 of downhole power unit 100 is transmitted to jarring tool 250 via the threaded connection to top sub 288. Specifically, to accomplish down jarring activity, threaded shaft 130 is moved linearly upwardly to cock jarring tool 250, as best seen in FIGS. 13-14. Thereafter, threaded shaft 130 is moved linearly downwardly, as shown in FIGS. 15-16, to energize jarring tool 250 by compression of spring systems 300, 316 and then to release the stored energy causing housing 252 to travel downwardly at high velocity and strikes pulling tool 400. This may be repeated by cycling threaded shaft 130 linearly upwardly then linearly downwardly to cock, energize and fire jarring tool 250, thereby again delivering a jarring force against the upwardly directed shoulder of latching mandrel 402 of pulling tool 400.

More specifically, once jarring tool 250 is in the cocked position as shown in FIG. 14, as threaded shaft 130 is moved linearly downwardly, force is applied to the upper mandrel 284 to compression spring system 300, thus collapsing compression spring system 300 to the degree permitted by the Belleville load spring assembly. Spring guide 312 will therefore be forced more into internal passage 316 of housing spacer 258. The force applied to compression spring system 300 is translated to upwardly directed shoulder 306 of housing spacer 258 and is also translated by the downwardly directed thrust shoulder 322 to compression spring assembly 316. This downwardly directed force is applied from compression spring assembly 316 to firing lug assembly 340, thereby moving firing lug assembly 340 downwardly until it comes into contact with firing ring 370. At this point, further downward movement of firing lug assembly 340 is restrained by firing ring 370. Further, by virtue of the tapered interengaging surfaces of firing lug assembly 340 and firing ring 370, a radially outwardly directed force movement is developed on firing lug assembly 340 which, except for the presence of supporting land 354, will cause firing lug assembly 340 to expand radially outwardly. It should be noted that firing ring 370 will not move under this condition, because of its fixed relation to firing ring positioning mandrel 366 which is in turn disposed in fixed relation with well tool 410 by virtue of its fixed relationship with lower mandrel 286.

As the downwardly directed force continues to increase, housing 252 will be moving downwardly as permitted by compression of load spring assembly 316 and detent body 334 will be moving downwardly with housing 252. Eventually, as the downward force increases, compression spring assembly 316 will have been loaded with its maximum extent. Continued downward movement of housing 252 continues until firing groove 356 is brought into registry with firing lug assembly 340, as best seen in FIG. 16. When this occurs, the individual firing lug segments 342 will then be suddenly moved radially outwardly by virtue of the camming engagement between the tapered surfaces of the firing lug segments 342 and firing ring 370. Movement of the firing lug segments 342 into firing groove 356 will suddenly release the axial restraint of firing lug assembly 340 and firing ring 370, thus releasing housing 252 to be driven rapidly downwardly under the force of compression spring assembly 316. Firing lug assembly 340, because of its radial expansion, will move downwardly past firing ring 370 as housing 252 moves rapidly downwardly. Downward housing movement will continue until lower anvil cap 270 comes into striking contact with the upwardly directed shoulder of latching mandrel 402 of pulling tool 400. Springs 316, 344 will cooperate immediately after firing to return firing lug assembly 340 to its contracted condition so that it is radially supported by support land 354, as best seen in FIG. 13.

Once jarring tool 250 is in this post firing configuration, recocking of the firing assembly is achieved by applying an upwardly directed force to housing 252 which is achieved via a linearly upward movement of threaded shaft 130. When this occurs, firing lug assembly 340 is moved upwardly until it comes into contact with firing ring 370. The engagement that takes place between firing lug assembly 340 and firing ring 370 imparts a radially directed force as well as a linearly directed force to firing lug assembly 340. The linearly directed upward force is translated from housing 252 to lower spacer member 338 and to recocking spring 344. As recocking spring 344 is compressed, detent body 334 will be moved upwardly relative to the restrained firing lug assembly 340, thus bringing recocking groove 358 into registry with the outer periphery of firing lug assembly 340, as best seen in FIG. 14. When this has occurred, the radially directed force applied to firing lug assembly 340 will suddenly move all of the segments 342 of firing lug assembly 340 into recocking groove 358. When this has been accomplished, firing lug assembly 340 will move past firing ring 370, also as best seen in FIG. 14. Simultaneously, the force of compression spring 344, acting upon lower spacer 338, will immediately shift firing lug assembly 340 to its restrained position in relation to support land 354. In this cocked configuration, jarring tool 250 is again ready for another down jarring stroke.

It should be noted that compression spring system 300 functions as an inverted accelerator to enhance the jarring activity of jarring tool 250. As downward force is applied through upper mandrel 284, compression spring system 300 is compressed so that the downward force applied to it is transmitted to housing 252. When release or firing of jarring tool 250 occurs, compression spring 300 induces additional downward impetus to housing 252. Also, in embodiments where compression spring system 300 is of lighter compressive weight, compression spring system 300 induces delayed downward impetus to housing 252, thus lengthening the duration of the downward shock pulse of jarring tool 250 against well tool 410.

Once well tool 410 has been dislodged, the downhole impact generator of the present invention and well tool 410 may be retrieved to the surface. Specifically, downhole power unit 100 is operated with linearly upward movement of threaded shaft 130 until locating keys 168 that are cooperatively positioned within radially enlarged region 166 engage with annular actuation surface 240 on lower releasable mandrel sections 230 of anchor 180. At the same time, radially enlarged region 164 engages collet member 162 of connecting sub 154 of downhole power unit 100 such that collet member 162 becomes engaged with annular actuation surface 238 on upper releasable mandrel sections 228.

Once downhole power unit 100 and anchor 180 are positioned as described, the operation of downhole power unit 100 to linearly move of threaded shaft 130 is reversed such that threaded shaft 130 is linearly moved in the downward direction. This linear movement creates an axial load across release mandrel 224 between annular actuation surfaces 238, 240. Continued linear movement will exert a sufficient axial tensile force to separate upper releasable mandrel section 228 from lower releasable mandrel section 230 at threaded connections 232, 236. Upon extension of release mandrel 224, compression energy stored in spring assembly 242 is released and anchor 180 is returned to its reduced diameter configuration. Once anchor 180 is in the reduced diameter configuration, the downhole impact generator of the present invention and well tool 410 may be retrieved to the surface.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A downhole impact generator adapted to be moved to a target location within a wellbore for transmitting a jarring force to a well tool positioned in the wellbore, the downhole impact generator comprising:

a downhole power unit having a moveable shaft; and a jarring tool operably engageable with the well tool and operably coupled with the moveable shaft of the downhole power unit such that when the jarring tool is operably engaged with the well tool, linear movement of the moveable shaft energizes the jarring tool such that a jarring force can be transmitted by the jarring tool to the well tool to dislodge the well tool from its position in the wellbore.

2. The downhole impact generator as recited in claim 1 wherein the downhole power unit further comprises a self-contained power source for providing electrical power and a controller that controls the operation of the moveable shaft.

3. The downhole impact generator as recited in claim 1 wherein the downhole power unit is coupled to a surface controller via a conductor cable that provides power and controls the operation of the moveable shaft.

4. The downhole impact generator as recited in claim 1 wherein linear movement of the moveable shaft in a first direction cocks the jarring tool, linear movement of the moveable shaft in a second direction energizes the jarring tool and further linear movement of the moveable shaft in the second direction releases the jarring tool to transmit the jarring force.

5. A downhole impact generator adapted to be moved to a target location within a wellbore for transmitting a jarring force to a well tool positioned in the wellbore, the downhole impact generator comprising:

a downhole power unit having a moveable shaft;

an anchor operably associated with the downhole power unit, the anchor operable between a running configuration and an anchoring configuration wherein the anchor longitudinally secures the downhole force generator within the wellbore; and a jarring tool operably engageable with the well tool and operably coupled with the moveable shaft of the downhole power unit such that when the jarring tool is operably engaged with the well tool and the anchor is in the anchoring configuration, linear movement of the moveable shaft energizes the jarring tool such that a jarring force can be transmitted by the jarring tool to the well tool.

6. The downhole impact generator as recited in claim 5 wherein the downhole power unit further comprises a self-contained power source for providing electrical power and a controller that controls the operation of the moveable shaft.

7. The downhole impact generator as recited in claim 5 wherein the downhole power unit is coupled to a surface controller via a conductor cable that provides power and controls the operation of the moveable shaft.

8. The downhole impact generator as recited in claim 5 wherein the running configuration of the anchor is a radially contracted configuration, wherein the anchoring configuration of the anchor is a radially expanded configuration and wherein the anchor is operated therebetween in response to movement of the moveable shaft.

9. The downhole impact generator as recited in claim 5 wherein the moveable shaft of the downhole power unit extends through a longitudinal bore of the anchor to the jarring tool.

10. The downhole impact generator as recited in claim 5 wherein the jarring tool further comprises a shifting tool for actuating the well tool from one operational state to another operational state.

11. The downhole impact generator as recited in claim 5 wherein the jarring tool further comprises a pulling tool for dislodging and retrieving the well tool from the wellbore.

12. The downhole impact generator as recited in claim 5 wherein linear movement of the moveable shaft in a first direction cocks the jarring tool, linear movement of the moveable shaft in a second direction energizes the jarring tool and further linear movement of the moveable shaft in the second direction releases the jarring tool to transmit the jarring force.

13. A method for transmitting a jarring force to a well tool positioned in a wellbore, the method comprising the steps of:

running a downhole impact generator to a target location in the wellbore, the downhole impact generator including a downhole power unit having a moveable shaft that is operably coupled to a jarring tool;

operably engaging the well tool with the downhole impact generator;

energizing the jarring tool by linear movement of the moveable shaft; and transmitting the jarring force to the well tool with the downhole impact generator, thereby dislodging the well tool from its position in the wellbore.

14. The method as recited in claim 13 further comprising the steps of providing electrical power to the downhole power unit with a self-contained power source for and controlling the operation of the moveable shaft with a self-contained controller.

15. The method as recited in claim 13 further comprising the steps of providing electrical power to the downhole power unit and controlling the operation of the moveable shaft via a conductor cable coupled to a surface controller.

16. The method as recited in claim 13 further comprising repeating the steps of energizing the jarring tool by linear movement of the moveable shaft and transmitting the jarring force to the well tool with the downhole impact generator.

17. A downhole impact generator adapted to be moved to a target location within a wellbore for transmitting a jarring force to a well tool positioned in the wellbore, the downhole impact generator comprising:

a downhole power unit having a moveable shaft; and a jarring tool operably engageable with the well tool and operably coupled with the moveable shaft of the downhole power unit such that when the jarring tool is operably engaged with the well tool, linear movement of the moveable shaft energizes the jarring tool such that a jarring force can be transmitted by the jarring tool to the well tool, wherein the downhole power unit is coupled to a surface controller via a conductor cable that provides power and controls the operation of the moveable shaft.

18. The downhole impact generator as recited in claim 17 wherein the jarring tool further comprises a shifting tool for actuating the well tool from one operational state to another operational state.

19. The downhole impact generator as recited in claim 17 wherein the jarring tool further comprises a pulling tool for dislodging and retrieving the well tool from the wellbore.

20. The downhole impact generator as recited in claim 17 wherein linear movement of the moveable shaft in a first direction cocks the jarring tool, linear movement of the moveable shaft in a second direction energizes the jarring tool and further linear movement of the moveable shaft in the second direction releases the jarring tool to transmit the jarring force.

21. A downhole impact generator adapted to be moved to a target location within a wellbore for transmitting a jarring force to a well tool positioned in the wellbore, the downhole impact generator comprising:

a downhole power unit having a moveable shaft; and a jarring tool operably engageable with the well tool and operably coupled with the moveable shaft of the downhole power unit such that when the jarring tool is operably engaged with the well tool, linear movement of the moveable shaft energizes the jarring tool such that a jarring force can be transmitted by the jarring tool to the well tool, wherein linear movement of the moveable shaft in a first direction cocks the jarring tool, linear movement of the moveable shaft in a second direction energizes the jarring tool and further linear movement of the moveable shaft in the second direction releases the jarring tool to transmit the jarring force.

22. The downhole impact generator as recited in claim 21 wherein the downhole power unit further comprises a self-contained power source for providing electrical power and a controller that controls the operation of the moveable shaft.

23. The downhole impact generator as recited in claim 21 wherein the downhole power unit is coupled to a surface controller via a conductor cable that provides power and controls the operation of the moveable shaft.

24. The downhole impact generator as recited in claim 21 wherein the jarring tool further comprises a shifting tool for actuating the well tool from one operational state to another operational state.

25. The downhole impact generator as recited in claim 21 wherein the jarring tool further comprises a pulling tool for dislodging and retrieving the well tool from the wellbore.

26. A method for transmitting a jarring force to a well tool positioned in a wellbore, the method comprising the steps of:

running a downhole impact generator to a target location in the wellbore, the downhole impact generator including a downhole power unit having a moveable shaft that is operably coupled to a jarring tool;

providing electrical power to the dowuhole power unit and controlling the operation of the moveable shaft via a conductor cable coupled to a surface controller;

operably engaging the well tool with the downhole impact generator;

energizing the jarring tool by linear movement of the moveable shaft; and transmitting the jarring force to the well tool with the downhole impact generator.

27. The method as recited in claim 26 wherein the step of transmitting the jarring force to the well tool with the downhole impact generator further comprises actuating the well tool from one operational state to another operational state.

28. The method as recited in claim 26 wherein the step of transmitting the jarring force to the well tool with the downhole impact generator further comprises dislodging the well tool from the wellbore.

29. The method as recited in claim 26 further comprising repeating the steps of energizing the jarring tool by linear movement of the moveable shaft and transmitting the jarring force to the well tool with the downhole impact generator.

30. A method for transmitting a jarring force to a well tool positioned in a wellbore, the method comprising the steps of:

running a downhole impact generator to a target location in the wellbore, the downhole impact generator including a downhole power unit having a moveable shaft that is operably coupled to a jarring tool;

operably engaging the well tool with the downhole impact generator;

energizing the jarring tool by linear movement of the moveable shaft;

transmitting the jarring force to the well tool with the downhole impact generator; and repeating the steps of energizing the jarring tool by linear movement of the moveable shaft and transmitting the jarring force to the well tool with the downhole impact generator.

31. The method as recited in claim 30 further comprising the steps of providing electrical power to the downhole power unit with a self-contained power source for and controlling the operation of the moveable shaft with a self-contained controller.

32. The method as recited in claim 30 further comprising the steps of providing electrical power to the downhole power unit and controlling the operation of the moveable shaft via a conductor cable coupled to a surface controller.

33. The method as recited in claim 30 wherein the step of transmitting the jarring force to the well tool with the downhole impact generator further comprises actuating the well tool from one operational state to another operational state.

34. The method as recited in claim 30 wherein the step of transmitting the jarring force to the well tool with the downhole impact generator further comprises dislodging the well toot from the wellbore.

* * * * *